US006088939A

United States Patent [19]

Logan

[11] Patent Number: 6,088,939

[45] Date of Patent: Jul. 18, 2000

[54] IMPLEMENT ADAPTER FOR AN EXCAVATION TOOL ASSEMBLY

[76] Inventor: John Duncan Logan, P.O. Box 392, Seward, Ak. 99664

[21] Appl. No.: 09/264,574

[22] Filed: Mar. 8, 1999

Related U.S. Application Data

[63] Continuation-in-part of application No. 09/116,957, Jul. 17, 1998.

[51] Int. Cl.[7] ..... E02F 3/76

[52] U.S. Cl. ..... 37/468; 37/404; 37/407; 403/24

[58] Field of Search ..... 37/468, 404, 403, 37/405, 406, 407, 444; 403/24

[56] References Cited

U.S. PATENT DOCUMENTS

| | | | |
|---|---|---|---|
| 2,664,251 | 7/1953 | Smith . | |
| 2,986,826 | 6/1961 | Timmons . | |
| 3,039,210 | 6/1962 | Slaughter . | |
| 3,043,032 | 7/1962 | Discenza . | |
| 3,181,256 | 5/1965 | Discenza . | |
| 3,195,250 | 7/1965 | Robinson . | |
| 3,469,330 | 9/1969 | Hood et al. . | |
| 3,523,380 | 8/1970 | Bolyard et al. . | |
| 3,665,622 | 5/1972 | Lamb . | |
| 3,864,793 | 2/1975 | Guest . | |
| 3,915,501 | 10/1975 | Cobb et al. . | |
| 4,009,529 | 3/1977 | Johnson . | |
| 4,087,010 | 5/1978 | Stormon . | |
| 4,100,688 | 7/1978 | Grist . | |
| 4,125,952 | 11/1978 | Jennings . | |
| 4,360,980 | 11/1982 | Jarvis . | |
| 4,550,512 | 11/1985 | Felstet . | |
| 4,974,349 | 12/1990 | Timmons . | |
| 5,253,449 | 10/1993 | Webb et al. . | |
| 5,297,351 | 3/1994 | Cote . | |
| 5,544,435 | 8/1996 | Somera . | |
| 5,596,825 | 1/1997 | Von Schalscha . | |
| 5,639,205 | 6/1997 | Kaczmarczyk et al. . | |
| 5,678,332 | 10/1997 | Hawkins . | |
| 5,865,594 | 2/1999 | Kim | 37/468 X |
| 5,890,871 | 4/1999 | Woerman | 37/468 X |

*Primary Examiner*—Christopher J. Novosad
*Attorney, Agent, or Firm*—Donald J. Lecher

[57] ABSTRACT

An implement adapter for providing excavation versatility that couples with and attaches to an excavation tool assembly for mounting a working implement thereon. The implement adapter comprises a frame for holding a working implement, wherein the frame is coupled and semi-fixedly attached to an excavation tool assembly. A parking projection holds the coupling element of the frame at a sufficient height above a surface when the implement adapter is detached from the excavation tool assembly and supported on the surface by the parking projection and a lowermost portion of either the frame or the working implement. The height at which the coupling portion is held by the parking projection enables engagement of the coupling portion with a cooperative coupling element on the excavation tool assembly without the need for any manual assistance. Additionally, the implement adapter has sliding and rotating connecting elements capable of connection to various sizes of excavation tools via manual or remotely actuated fastening mechanisms.

37 Claims, 9 Drawing Sheets

IMPLEMENT ADAPTER FOR AN EXCAVATION TOOL ASSEMBLY

This application is a continuation-in-part of U.S. Patent Application Ser. No. 09/116,957 filed Jul. 17, 1998, which is incorporated herein.

BACKGROUND OF THE INVENTION

1. Field of Invention

The present invention pertains to the field of art encompassing earth-moving machines and more particularly to excavation tool assemblies, for example, of the kind comprising excavation buckets to which working implements are mounted thereon. The present invention relates to a detachable implement adapter that is initially coupled to an excavation tool assembly without the need for manual assistance. Additionally, the implement adapter provides improved excavation versatility, by mounting upon various sizes or excavation tools and articulating attached working implements in multiple ranges of motion.

2. General Background and Discussion of Prior Art

In the past, auxiliary implements generally comprising of a unitary constructed implement have been fastened directly to a bucket with a plurality of manually connected fasteners. This attachment method creates a labor and time intensive process of installation and detachment of the heavy working implements. As a result of the implements' heavy weight to withstand bending influences under operation, the manual labor of several persons is required to position and fasten the implement on the excavation tool. The unitary construction of such implements also results in costly replacement or repairing after appreciable wear of the cutting edge has taken place.

Examples of what is known in the prior art showing a blade implement for attachment directly to an excavation bucket, are as follows: Smith, U.S. Pat. No. 2,644,251, Discenza, U.S. Pat. Nos. 3,043,032 & 3,181,256; Robinson, U.S. Pat. No. 3,195,250; Slaughter, U.S. Pat. No. 3,039,210; Hood et al., U.S. Pat. No. 3,469,330; Bolyard et al., U.S. Pat. No. 3,523,380; Johnson, U.S. Pat. No. 4,009,529; Jarvis, U.S. Pat. No. 4,360,980; Webb et al., U.S. Pat. No. 5,253,449; Cote, U.S. Pat. No. 5,297,351; and Von Schalscha, U.S. Pat. No. 5,596,825. Felstet, U.S. Pat. No. 4,550,512 teaches an excavator bucket with interchangeably detachable implements connecting directly to the excavator bucket. Jennings, U.S. Pat. No. 4,125,952 teaches a fork type implement for attachment to an excavator bucket. Timmons, U.S. Pat. No. 4,974,349 teaches a compactor attached to the back of an excavator bucket. Guest, U.S. Pat. No. 3,864,793 and Stormon, U.S. Pat. No. 4,087,010 teaches an apparatus for mounted tools to an excavator bucket.

Implements have also been attached to cumbersome mounting devices designed for a single excavation bucket. Timmons, U.S. Pat. No. 2,986,826 and Lamb, U.S. Pat. No. 3,665,622 teaches a device for mounting to a lift bucket upon which a working implement is attached. However, these mounting brackets fail to have any adjustable feature allowing for adaptation on excavation buckets of different sizes. Additionally, the mounting arrangement of the working implement on these mounting devices fails to allow for any type of articulation of the implement relative to the mounting device.

Finally, none of the prior art teaches an implement adapter for mounting on an excavation tool assembly where the adapter's geometry automatically holds the adapter in a position to be engaged by the excavation tool assembly without any need of manual assistance. Kaczmarczyk et al., U.S. Pat. No. 5,639,205 teaches a parkable grapple for attachment to a front-end loader holder, having a folding parking foot (ref. no. 102) that must be manually extended for holding the detached grapple at a certain height for engagement with the front-end loader holder. Grist, U.S. Pat. No. 4,100,688 teaches a compacting roller which can be mounted to a customized portion of an excavator boom arm in which a connecting pin must be manually inserted for final attachment.

OBJECTS AND ADVANTAGES

It is the principle object of the present invention to provide an improved lower coupling mechanism for an implement adapter allowing for a method of attachment to an excavation tool assembly wherein there is no need for manual assistance.

It is a further object of the present invention to provide an adjustable implement adapter which enables the manufacture of a universal implement adapter for adjustment to fit a wide range of sizes of excavation tools, e.g., on excavation buckets and excavation thumbs.

It is a further object of the present invention to provide an implement adapter that accommodates both the rotation and skewing articulation of mounted implements.

SUMMARY OF THE PRESENT INVENTION

The herein disclosed and claimed implement adapter for an excavation tool assembly of universal applicability readily accommodating mounting to a wide variety of excavation buckets (the like of which includes, but is not limited to, track loaders, backhoes, excavators, wheel loaders and skid steer loaders), and accommodating a wide variety of working implements mounted thereon. The implement adapter comprises a frame means adapted to hold a desired working implement, coupling and attachment means integral with the frame means for affixing to an excavation tool assembly, and parking means for holding the coupling means at a sufficient height above a surface when the implement adapter is detached from the excavation tool assembly and supported on the surface by the parking means and said lowermost portion of either the frame means or the implement. The height the coupling means is oriented by the parking means enables engagement of the coupling means with a cooperative coupling means on the excavation tool assembly. This enables the initial attachment of the implement adapter to an excavation tool without any need for manual assistance.

The implement adapter additionally has sliding an d rotating connecting elements that either manually or automatically attach to an excavation tool assembly. These sliding and rotating connecting elements are adjustable along a portion of the implement adapter frame and can be semi-permanently fixed relative to the implement adapter. The adjustable feature of the connecting elements accommodates the mounting and operation of a single implement adapter on excavation tools of various sizes, thereby eliminating the need for multiple non-adjustable implement adapters sized for specific excavation tools.

DETAILED DESCRIPTION OF THE PREFERRED EMBODIMENT

Figure 1:
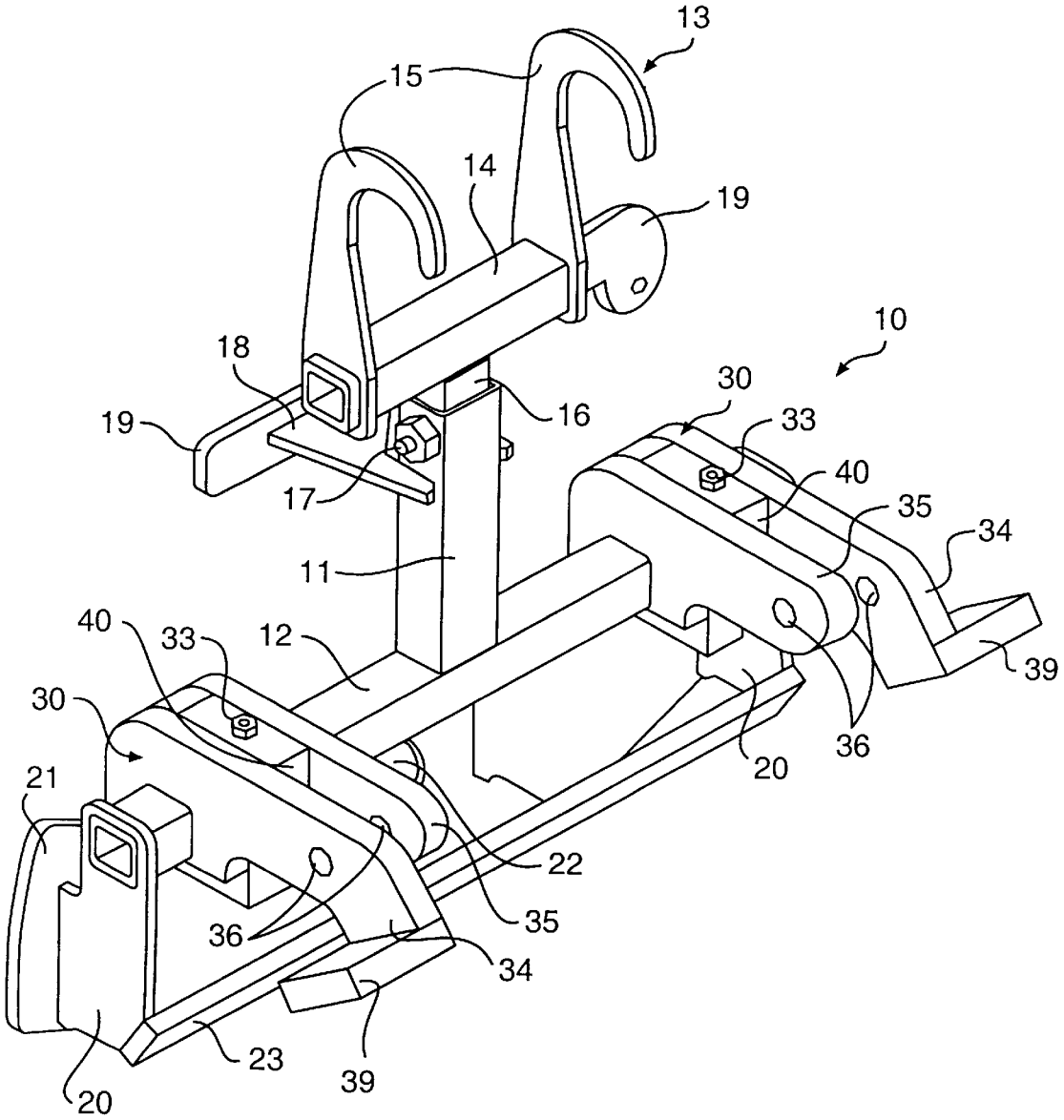
FIG. 1 Rear perspective view of the improved implement adapter.
Figure 2:
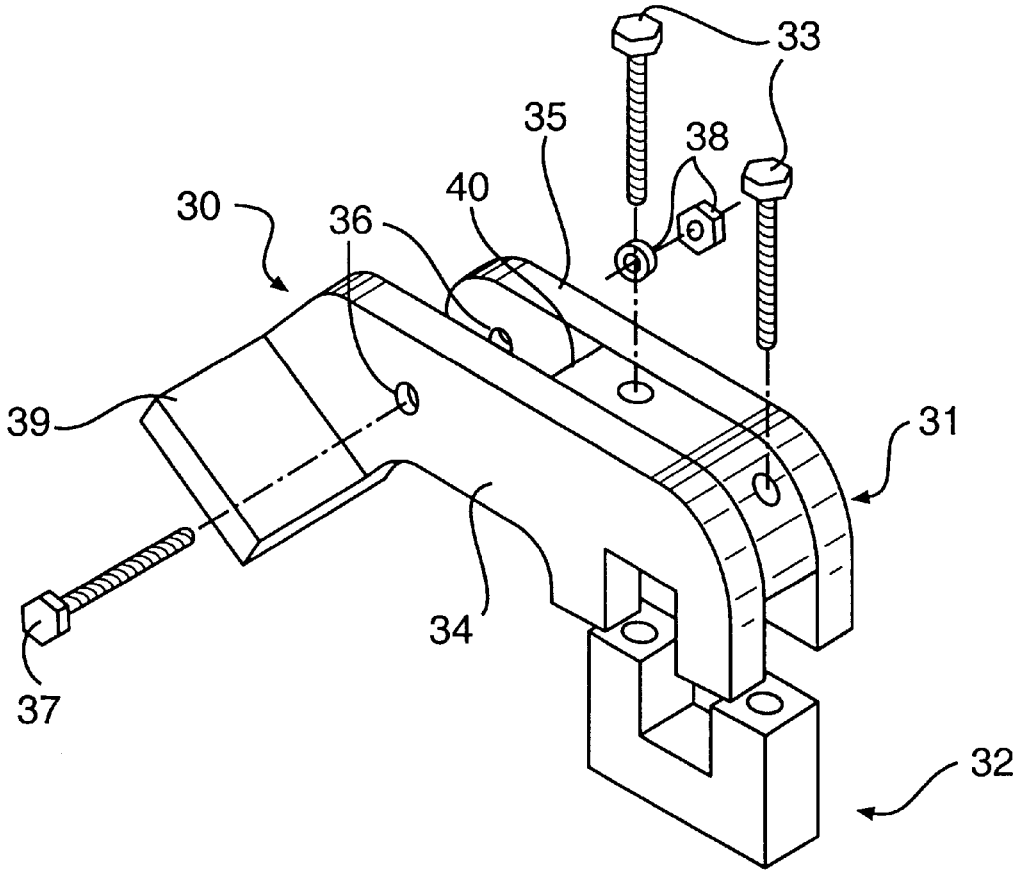
FIG. 2 Front perspective view of the coupling foot assembly.
Figure 3:
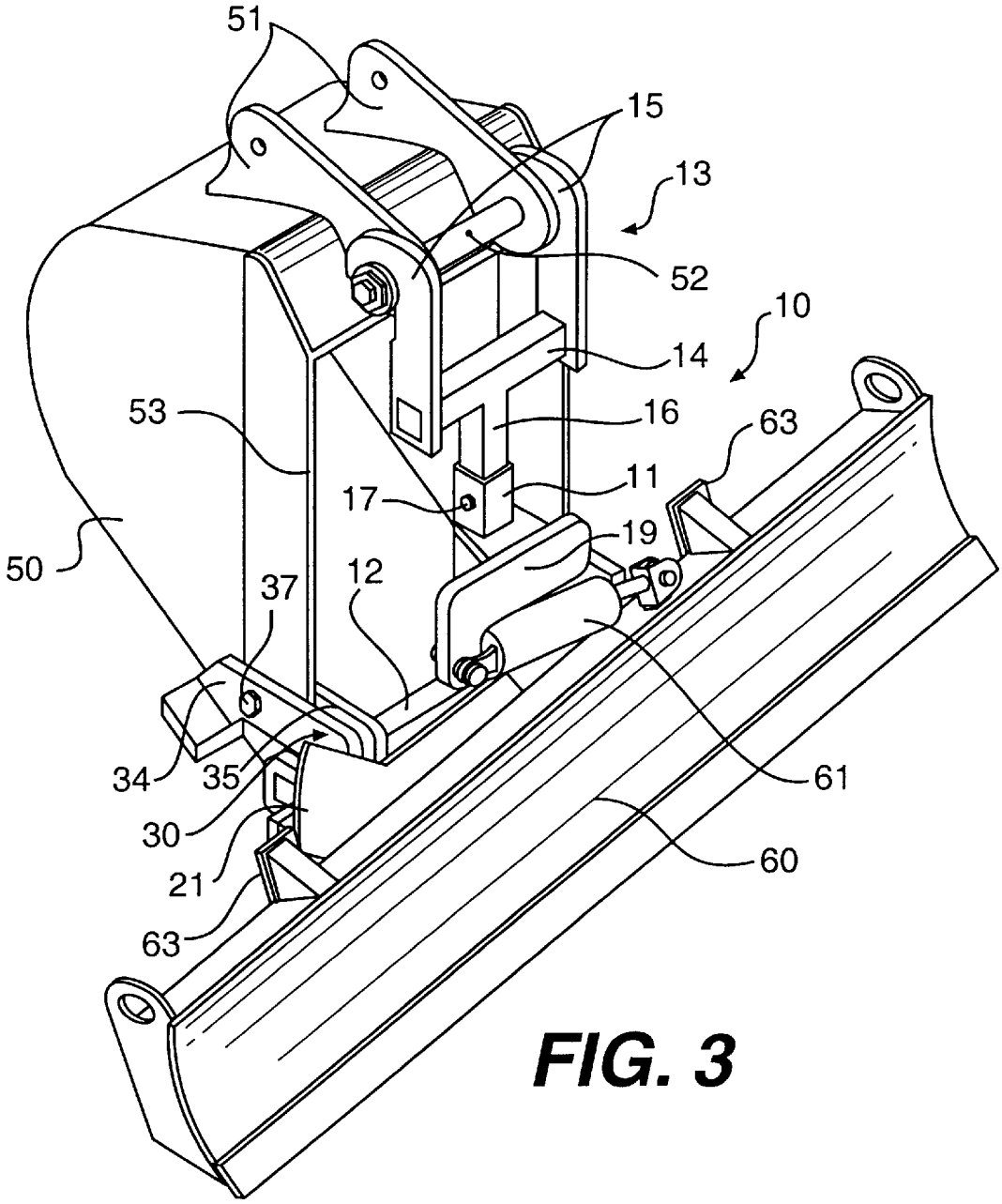
FIG. 3 Front perspective view of the implement adapter attached to a bucket with a hydraulically tilting blade.

FIGS. 1–3. DESCRIPTION OF AN IMPROVED IMPLEMENT ADAPTER FOR ATTACHMENT TO AN EXCAVATION TOOL.

FIG. 1 illustrates an improved implement adapter 10 having a frame comprised of a vertical frame member 11 attached to a midpoint of a horizontal frame member 12. The upper portion the vertical frame member 11 has a coupling yoke assembly 13 comprising a horizontal spanner 14 having distal ends to which are attached parallel spaced coupling hooks 15 having semi-circular bearing surfaces on the upper distal ends. The coupling yoke assembly 13 is movable relative to the vertical frame member 11 by a downward projecting member 16 having a plurality of fastening positions that slides within the vertical frame member 11, wherein the coupling yoke assembly 13 can be affixed relative to the vertical frame member 11 by means of a fastener 17. Directly beneath the fastener 17 is a forward projecting bracket 18 to which is mounted a hydraulic actuator mounting plate 19.

Fastened to each distal end portion of the horizontal frame member 12 are connecting plates 20. A forward portion of each connecting plate 20 is connected to an implement mounting plate 21 having a centrally located implement rotation mounting hole 22. This implement rotation mounting hole 22 allows an implement, when mounted on the implement mounted plate 21, to be rotated about the axis of the mounting hole 22 relative to the implement mounting plate when an actuation device, such as a hydraulic cylinder, is connected to the implement and the hydraulic actuator mounting plate 19, as disclosed in the parent application. Additionally, a downwardly facing rear portion of the connecting plates 20 are connected to a pressure plate 23 for engagement with a load bearing portion of an excavation tool assembly.

Lower connecting assemblies 30 are located on the horizontal frame member 12 between each connecting plate 20 and midpoint of the horizontal frame member 12 where vertical frame member 11 is attached. These lower connecting assemblies 30 are capable of being moved along the horizontal frame member 12 and can thereafter be affixed semi-permanently anywhere between the distal ends of horizontal frame member 12 and the vertical frame member 11.

FIG. 2 shows the lower connecting assemblies 30 comprising of a upper connecting portion 31 which is slideably disposed and engages the top portion of horizontal frame member 12, and a lower clamping portion 32 which is slideably disposed and engages the bottom portion of horizontal frame member 12. Fasteners 33 connect the upper connecting portion 31 with the lower connecting portion 32. When sufficient torque is applied to fasteners 33, a clamping force is created between the upper connecting portion 31 and the lower clamping portion 32 relative to the horizontal frame member 12, thus enabling the semi-permanent affixing of the lower connecting assembly 30 to the horizontal frame member 12.

The upper connecting portion 31 of lower connecting assembly 30 has a first rearward projecting leg 34 and a second rearward projecting leg 35, both spaced a distance parallel to each other. Both first and second rearward projecting legs 34 & 35 have coaxial fastener holes 36 for mounting, in a first embodiment, a fastening device 37, therethrough for connection with cooperative fasteners 38. The distal end of the first rearwardly projecting leg 34 has a parking foot 39 projecting orthogonally from the outward surface of the first rearwardly projecting leg 34. An optional rearwardly facing abutment stop 40, best viewed in FIG. 1, spans between the inner portions of the first and second rearwardly projecting legs 34 & 35 of upper connecting portion 31.

FIG. 3 illustrates the mounting of the improved implement adapter 10 upon an excavation tool assembly, in this case an excavation bucket 50. Mounting flanges 51 on the top of excavation bucket 50 enable the connection to a hydraulic boom arm of an excavator. A. modified wrist pin 52 fits through the forward mounting portion of the mounting flanges 51 for connection with the hydraulic boom arm. The wrist pin 52 extends outwardly past the outer edges of the mounting flanges 51 to enable coupling with the coupling hooks 15 of the yoke assembly 13.

After adjusting the proper height of the yoke assembly 13 with respect to the vertical frame member 11 by means of faster 17 inserted into one of the plurality of fastener positions on the downward projecting member 16, the implement adapter 10 is coupled to the wrist pin 52 and is then ready to be rotated toward the forward edge of the excavation bucket 50. The lower connecting assemblies 30 are slid along the horizontal frame member 12 such that the each forward vertical cutting edge 53 of the bucket 50 is positioned between the first and second rearwardly projecting legs 34 & 35 of each lower connecting assembly 30. The lower connecting assemblies 30 are then fixably secured to the horizontal frame member 12 by means of tightening the fasteners 33 as previously disclosed.

The implement adapter 10 is then rotated about wrist pin 52 until the forward vertical cutting edges 53 of bucket 50 contacts the abutment stops 40 of each lower connecting assembly. In a first embodiment, fastener 37 is then inserted through the coaxial hole 36 of first rearwardly projecting leg 34 into a co-axially aligned hole in bucket 50, and finally through the coaxial hole 36 of the second rearwardly projecting leg 56 to be fastened with cooperative fasteners 38. An alternative embodiment for the automatic and remote fastening of the lower connecting assembly 30 to the excavation bucket 50 replaces the fastener 37 and cooperative fasteners 38 with a remotely activated device, e.g., a hydraulic cylinder or electric solenoid. This remotely activated device would automatically engage a fastening or latching element to either (1) the coaxial hole 36 and the co-axially aligned hole in bucket 50, or (2) a cooperative fastening or latching element located on the excavation tool.

A blade type implement 60 is mounted to implement mounting plate 21 and held in rotational engagement via the centrally located rotation mounting hole 22. Rotation of the implement 60 occurs when the remotely actuated hydraulic cylinder 61 is activated when connected to the hydraulic actuator mounting plate 19 and an over-center top edge portion of the implement 60, thus causing the implement to rotate about an axis orthogonal to the axis of the vertical frame member 11.

There are two instances when operation of the implement 60 will generate a forward force on the implement causing the implement to separate from the implement mounting plate 21. The first instance is when the implement 60 is moved against material in a rearward direction, i.e., where the implement is dragged rearwardly against working material. The second occurs while the implement 60 moves in a forward direction and only one of the longitudinal edges of the implement 60 catches on working material creating a torsional stress on the opposite causing the implement 60 to move away from the implement mounting plate 21. To address these issues, implement 60 has two wear plate assemblies 63 attached to the rear surface of the implement 60 for engagement with rearward facing distil end surfaces of the implement mounting plate 21. An inside forward facing surface of the rear wear plates 63 contacts the rearward facing distal end surfaces of the implement mounting plate 21, as shown in FIG. 3. The wear plate assemblies 63 contacting the implement mounting plate 21 retain the implement from movement in a forward direction, thus providing reduced stress upon the connection of the implement mounting plate 21 and the implement 60.

FIGS. 4A–4D. DESCRIPTION OF ATTACHMENT SEQUENCE OF AN IMPLEMENT ADAPTER TO AN EXCAVATION TOOL ASSEMBLY WITHOUT MANUAL ASSISTANCE.

Figure 4B:
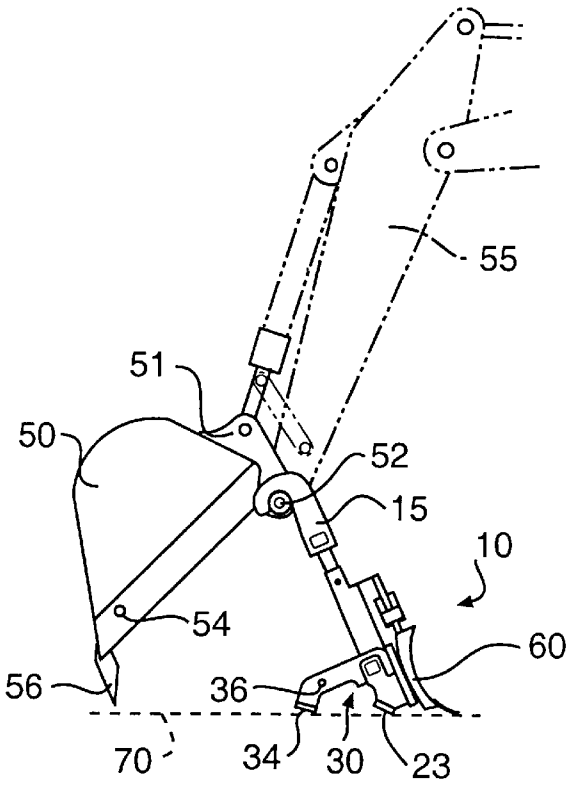
FIG. 4B Side view of the second attachment sequence step wherein the bucket coupling mechanism is engaged with the upper coupling portion of the implement adapter.
Figure 4A:
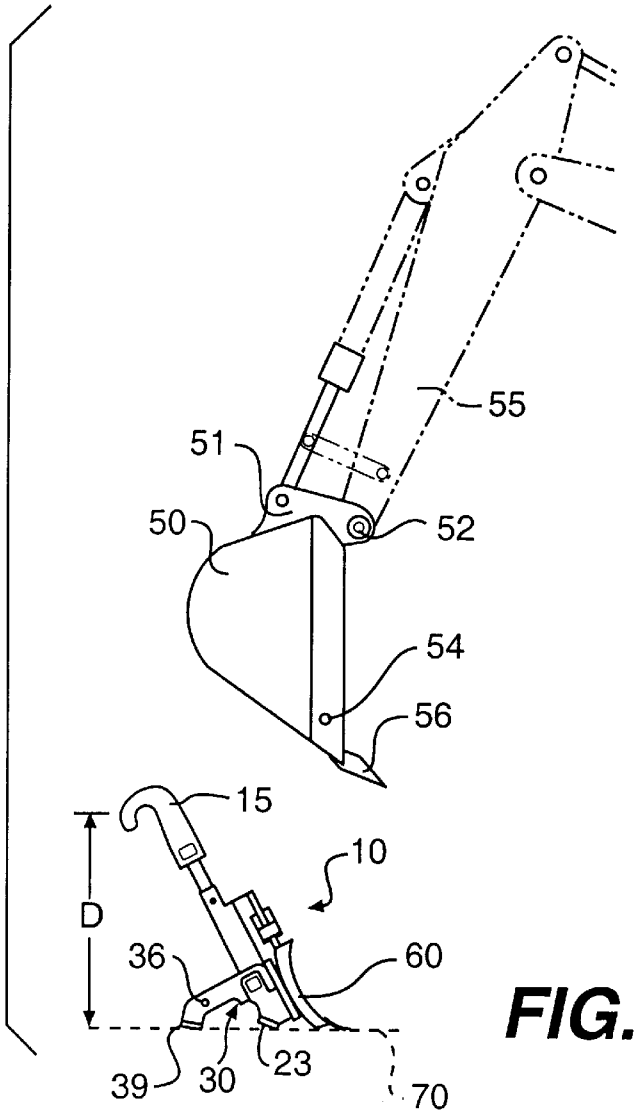
FIG. 4A Side view of the first attachment sequence step wherein the adapter is resting on ground.

FIGS. 4A–D illustrate the attachment sequence of the improved implement adapter 10 of FIGS. 1–3 to an excavation bucket 50. FIG. 4A illustrates implement adapter 10 resting on a horizontal surface 70 supported generally by the lower connecting assemblies 30, pressure plate 23 and the lowermost rearward portion of blade implement 60. Parking feet 39 of the lower connecting assemblies 30 supports the of implement adapter 10 at a predetermined angle with respect to surface 70. This enables the coupling hooks 15 to be parked at a certain distance D above the surface 70 when the implement adapter 10 rests on the surface 70. Excavation bucket 50 is prepared for engagement with the implement adapter 10 with the wrist pin 52 mounted on the front portion of the mounting flange 51 of excavation bucket 50. Once the excavation bucket 50 is pivotally connected to the excavation boom arm 55, the wrist pin 52 can be aligned with respect to the coupling hooks 15 of the implement adapter 10.

FIG. 4B illustrates the rearwardly tilting position of the excavation bucket 50 as lowered by the boom arm 55 at the moment of coupling engagement between the coupling hooks 15 and the wrist pin 52. The distance D which coupling hooks 15 are parked above the surface 70, allows the boom arm 55 to manipulate the excavation bucket 50 and its attached wrist pin 52 into engagement with the semicircular bearing portions of the coupling hooks 15 without the bucket teeth 56 or any other portion of the forward lowermost portion of the excavation bucket 50 interfering with the surface 70.

Once coupling hooks 15 are rotatably secured to the wrist pin 52, excavator boom arm 55 is raised upward causing implement adapter 10 to rotate simultaneously about the axis of the wrist pin 52 and about a longitudinal axis created by the lowermost portion of implement adapter 10 bearing along the surface 70. After excavator boom arm 55 has raised implement adapter 10 completely off the surface 70, (FIG. 4C), the hydraulic actuators of the boom arm 55 rotate the excavation bucket 50 around the wrist pin 52 to move the forward open edge of excavation bucket 50 toward the implement adapter 10. In this manner, the implement adapter 10 is initially coupled to the excavation bucket 50 without the need for any manual assistance.

Figure 4D:
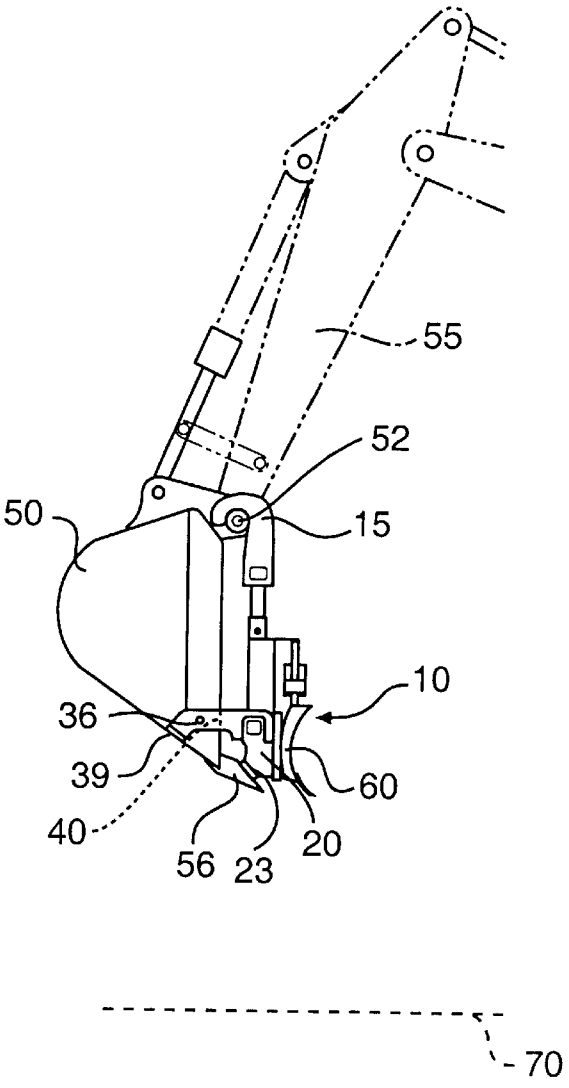
FIG. 4D Side view of the fourth and final attachment sequence step wherein the lower portion of the implement adapter is positioned to enable fastening to the excavation bucket.
Figure 4C:
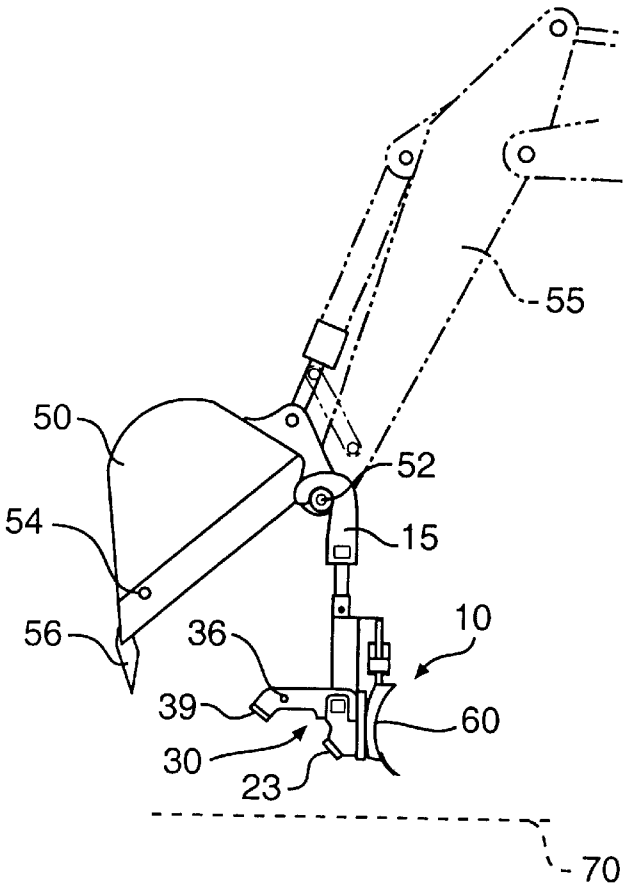
FIG. 4C Side view of the third attachment sequence step wherein the implement adapter is lifted off the ground while pivotally coupled to the bucket.

FIG. 4D illustrates the final securing attachment of the implement adapter 10 to excavation bucket 50. The excavation bucket 50 is then rotated about wrist pin 52 to such a position where the forward vertical cutting edge 53 of excavation bucket 50 engages the abutment stops 40 of the lower connecting assemblies, and/or the bucket teeth 56 engage the pressure plate 23 connected to the lower rearward portion of the connecting plates 20. Once in this position, fasteners can be manually or automatically engaged through the co-axial fastener holes 36 of lower connecting assembly 30 of the implement adapter 10 and through side connecting holes 54 of the excavation bucket 50, thus fully securing implement adapter 10 to the excavation bucket 50.

The advantage of the having the excavation tool contact either the abutment stops 40 and/or the pressure plate 23 is to transfer the loads generated by working implement through the implement adapter 10 directly to the excavation tool. By having either the abutment tabs 40 and/or the pressure plate 23 located very close to the resultant centerline of the force generated by the mounted implement under operation, the torsional stress in the implement adapter 10 is greatlv reduced.

Figure 5:
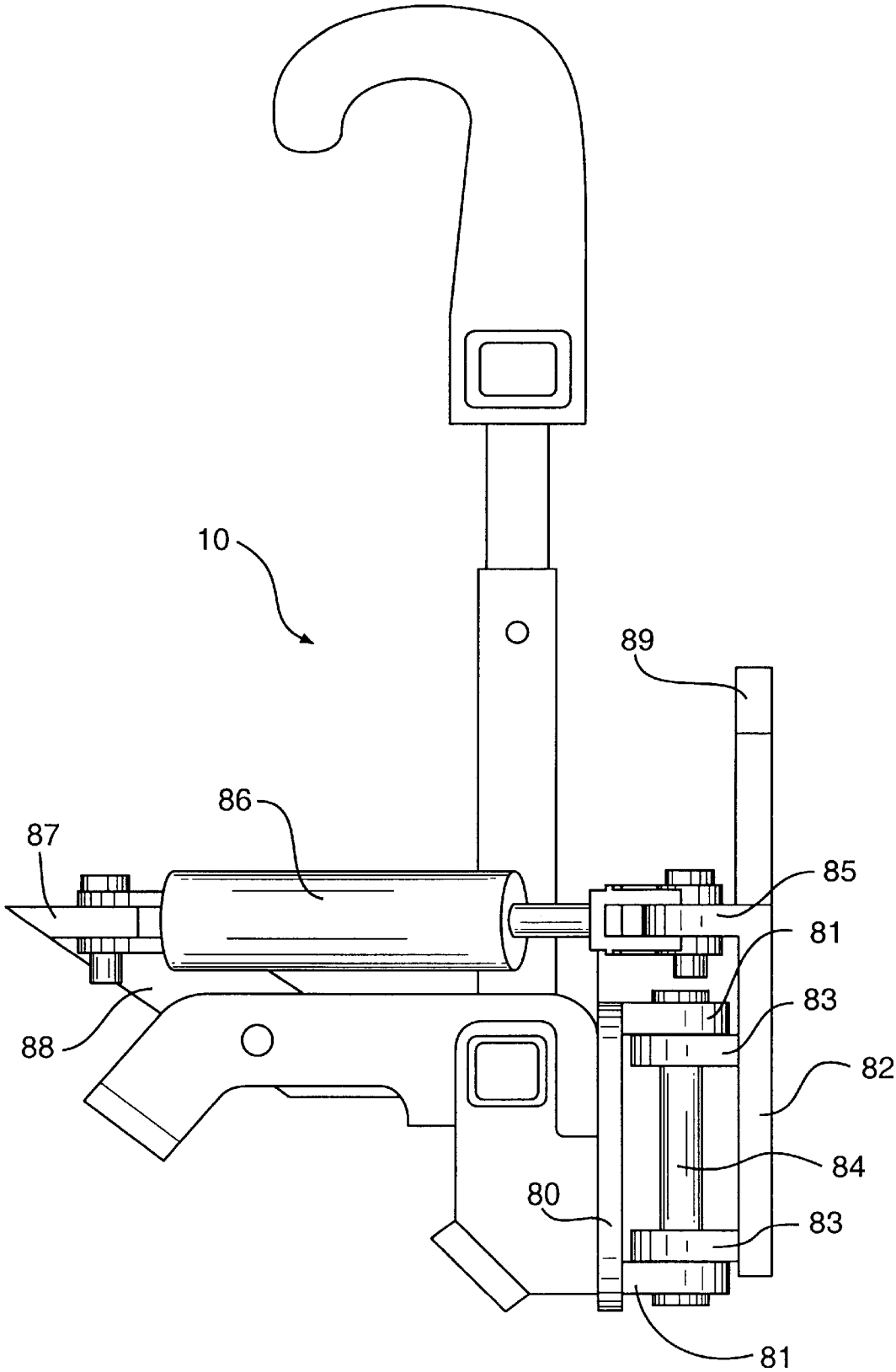
FIG. 5 Side view of an implement adapter with a hydraulic implement skewing mechanism.
Figure 6:
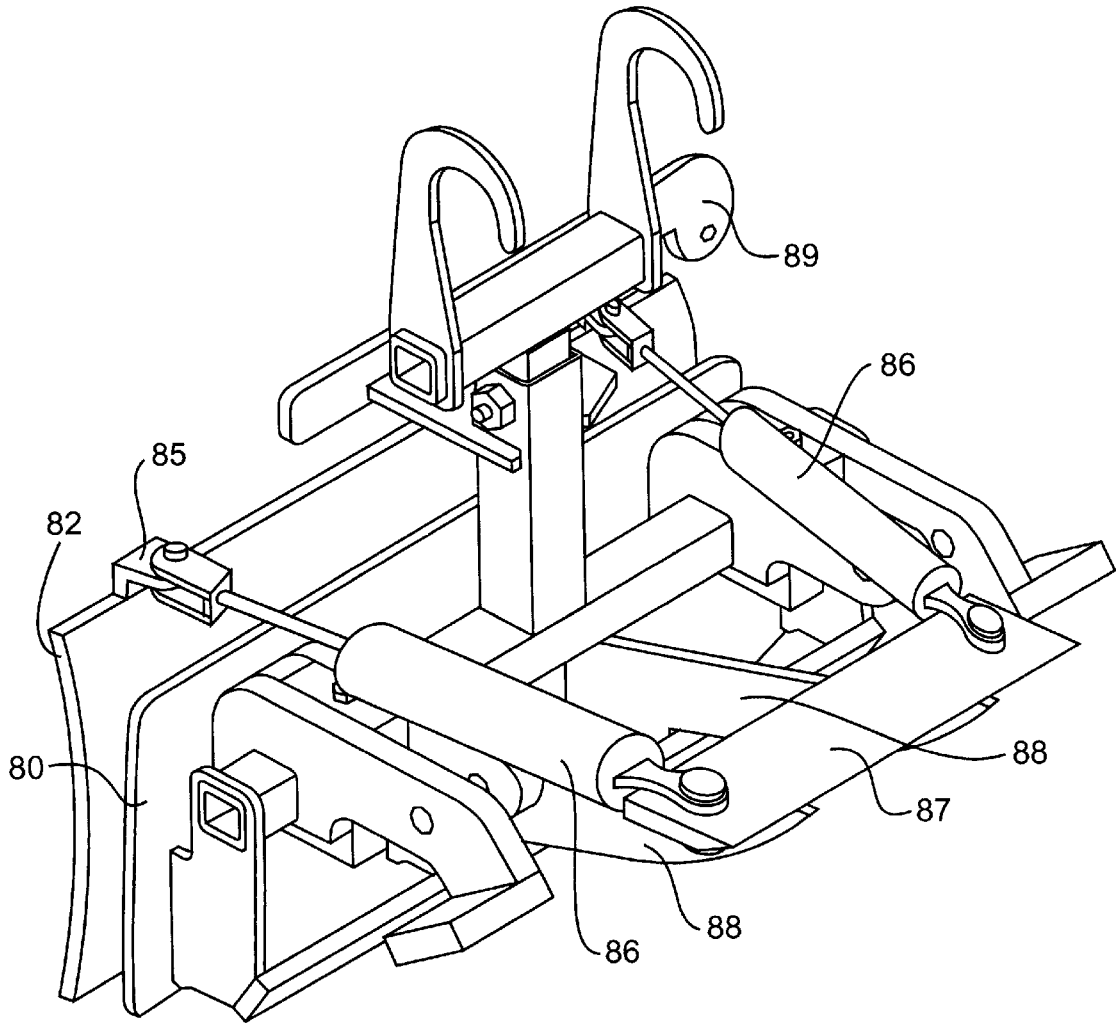
FIG. 6 Rear perspective view of an implement adapter with a hydraulic implement skewing mechanism.

FIGS. 5–6. DESCRIPTION OF AN ADJUSTABLE FRAME IMPLEMENT ADAPTER WITH A HYDRAULICALLY SKEWING IMPLEMENT MOUNTING PLATE.

The implement adapter 10 of FIGS. 1–4D can be modified with an additional feature that allows the implement adapter 10 to skew a mounted implement about a vertical axis. A fixed hinge plate 80 is mounted to the implement adapter 10 in a similar manner as the implement mounting plate 21 of FIGS. 1–4D. Upper and lower fixed hinge plate flanges 81 project in a forward direction having vertical co-axial located holes therethrough. A skewable mounting plate 82 is connected to the fixed hinge plate 80 by having rearwardly projecting upper and lower mounting plate flanges 83 with vertical co-axial located holes therethrough for alignment with the upper and lower fixed hinge plate flanges 81. A hinge pin 84 then is inserted through the co-axially aligned holes of the fixed hinge plate flanges 81 and the mounting plate flanges 83 to enable the skewable mounting plate 82 to rotate about the longitudinal axis of the hinge pin 84 relative to the fixed hinge plate 80.

Attached to upper off-center portions of the skewable mounting plate 82 are skewing actuator connections 85 which connect to first ends hydraulic skewing actuator assemblies 86. The second ends of the hydraulic skewing actuator assemblies 86 are connected to a hydraulic actuator rear support bracket 87 that are supported by bracket support arms 88 rearwardly projecting from the lower portion of the implement adapter 10. Rotation of the skewable mounting plate about the hinge pin 84 is accomplished when the hydraulic skewing actuator assemblies 86 are each operated in simultaneously opposite directions, i.e., with one hydraulic cylinder extending and the other retracting. A torsional force then rotates the skewable mounting plate 82 about the longitudinal axis of the hinge pin 84.

The previously disclosed rotational motion of the mounting plate 82 can be accomplished in addition to the skewable motion by means of a rotational actuator connection 89 located on an upper off-center portion of the skewable mounting plate 82. This rotational actuator connection 89 accepts a first end of a hydraulic actuator, and wherein the second end of the hydraulic actuator is connected to the implement (as shown if FIG. 3). Thus, the combination of both skewable and rotational motion can be accomplished with a working implement mounted on the implement adapter 10.

Figure 7:
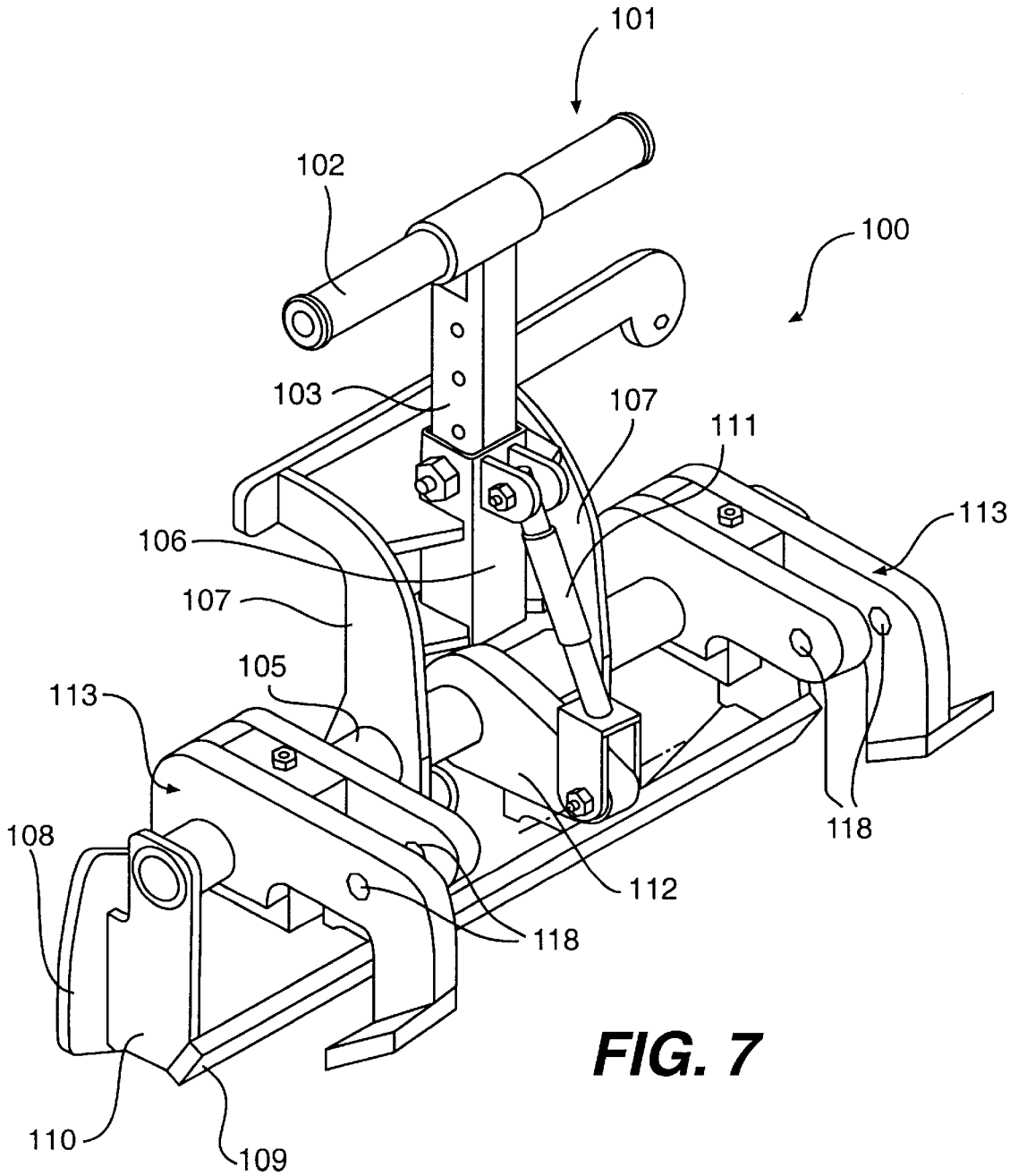
FIG. 7 Rear perspective view of an alternative embodiment of an implement adapter with lower coupling elements connected to a rotating shaft.
Figure 8B:
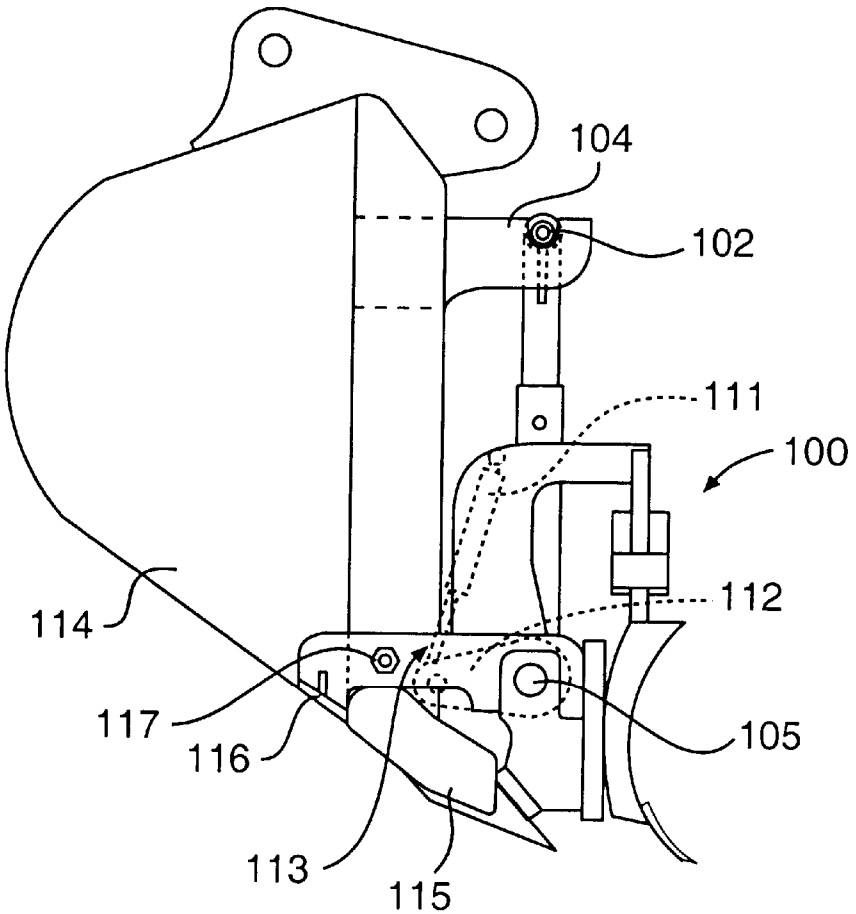
FIG. 8B Side view with the alternative embodiment of an implement adapter attached to a bucket with the lower coupling mechanism engaged to the cooperative coupling element on the bucket.
Figure 8A:
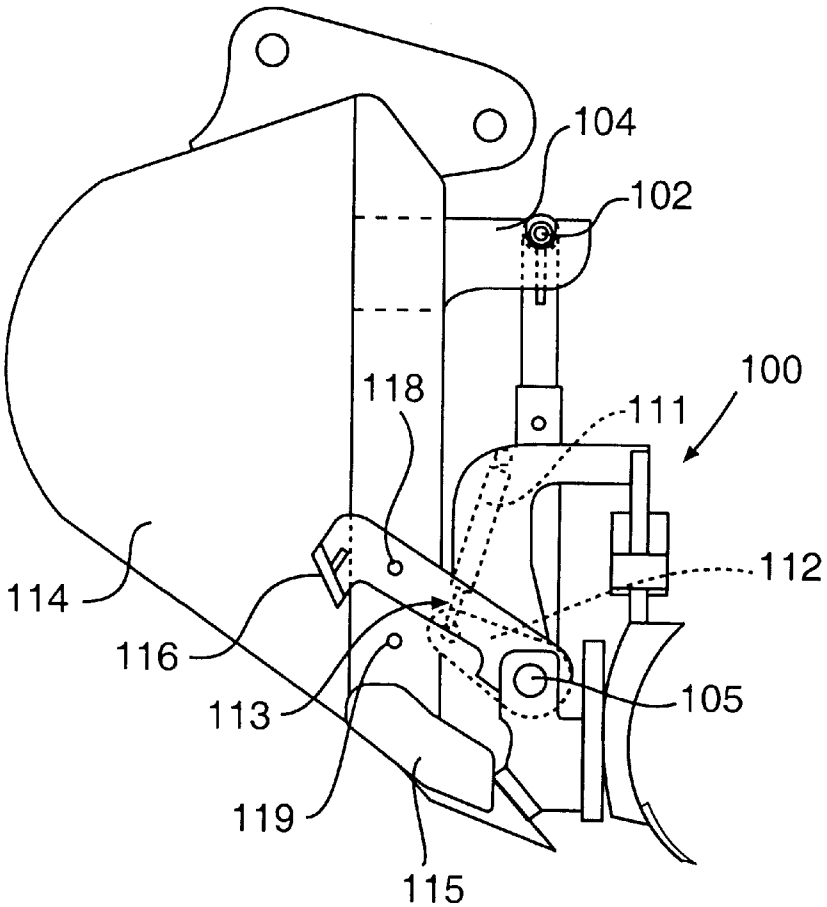
FIG. 8A Side view with the alternative embodiment of an implement adapter attached to a bucket with the lower coupling mechanism disengaged from the cooperative coupling element on the bucket.

FIGS. 7, 8A & 8B. DESCRIPTION OF AN ALTERNATIVE EMBODIMENT OF AN IMPLEMENT ADAPTER WITH LOWER COUPLING ELEMENTS CONNECTED TO A ROTATING SHAFT.

This embodiment discloses an implement adapter 100 replacing the coupling yoke assembly 13 of implement adapter 10 of FIGS. 1–6, with a coupling T-bar assembly 101, similar to the previously disclosed invention in the parent application. Generally, the coupling assembly 101 has a horizontal cylindrical bar 102 extending outward in two directions directing from the vertically adjustable portion of the vertical frame member 103. The coupling T-bar assembly 101 couples to an excavation tool assembly, e.g., an excavation bucket, by means of a cooperative coupling bearing brackets 104 each having semi-circular bearing surfaces and attached to an upper forward portion of the excavation tool assembly. This rotational coupling connection allows for the implement adapter 100 to be coupled with the excavation tool in the same matter as described in FIGS. 4A–4D, but is not dependent upon the location of the connecting wrist pin 52 relative to the excavation tool. Therefore, the cooperative coupling bearing brackets 104 can be mounted at appropriate positions on an excavation tool suitable for attaching the implement adapter 100 on the excavation tool.

FIGS. 7, 8A & 8B additionally disclose a modification to the implement adapter 10 of FIGS. 1–6 wherein the horizontal frame member 12 is replaced with a rotating shaft 105. A vertical frame member 106 is connected via arm members 107 to the implement mounting plate 108 and pressure plate 109. Both the implement mounting plate 108 and the pressure plate 109 are connected at distal end portions to rotational bearing plates 110 each having circular bearing portions to rotatably receive the distal end portions of the rotating shaft 105.

An actuating cylinder 111 is attached to the upper vertical frame member 106 and a cam member 112 located on and affixed to a central portion of the rotating shaft 105. Lower connecting assemblies 113 (similar in configuration to lower connecting assemblies 30 of FIGS. 1–6) are attached to rotating shaft 105 and are capable of being moved along the rotating shaft 105 and thereafter semi-permanently affixed anywhere between the distal ends of the rotating shaft 105 and the arm members 107. When the actuating cylinder 111 is extended or retracted, it rotates the rotating shaft 105 via cam member 112. The lower connecting assemblies 113 attached to rotating shaft 105 are therefore rotated about the longitudinal axis of the rotating shaft 105 when the actuating cylinder 111 is actuated.

FIGS. 8A & 8B describes the final attachment sequence of the implement adapter 100 to an excavation bucket 114. After the coupling T-bar assembly 101 has been coupled to cooperative coupling bearing brackets 104 mounted on the forward edge of the excavation bucket 114, the implement adapter 100 is moved into position to attach the lower connecting assemblies 113 to a lower portion of the excavation bucket 114. In this embodiment, excavation bucket 114 has side cutter plates 115 mounted on each outer edge of the lower cutting surface of the excavation bucket 114. When the implement adapter 100 is attached to the excavation bucket 114, the actuating cylinder 111 is retracted, thus causing the iower connecting assemblies 113 to be rotated in an upward direction as implement adapter 100 is brought into contact with the lower portion of the excavation bucket 114, as shown in FIG. 8A. The outer portions of the lower connecting assemblies 113 each have a downwardly projecting parking foot 116 which is positioned on the outside edge of the excavation bucket 114. When the implement adapter 100 is finally aligned with the front edge of the excavation bucket 114, the actuating cylinder 111 extends thereby rotating the lower connecting assemblies 113 in a downward direction to engage the rearmost portion of the side cutter plates 115 as shown in FIG. 8B. In this position, the implement adapter 100 is securely latched to the excavation bucket 114 without any need for manual manipulation of the implement adapter 100.

For additionally securement of the implement adapter 100 to the excavation bucket 114, a fastener 117 may be inserted through co-axially located fastening holes 118 in the distal end portions of the lower connecting assemblies 113 to be coupled with a cooperative fastening hole 119 in the side edge of the excavation bucket 114. This manual fastening may also be replaced with a remotely activated device to automatically engage a fastening or latching element to either (1) the co-axially located fastening holes of the lower connecting assemblies 113 and cooperative fastening hole in the excavation tool, or (2) an additional cooperative fastening or latching element located on the excavation tool.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. An implement adapter for use in combination with an excavation tool, said implement adapter comprising:

frame means for holding working implements;

coupling means integral with an upper portion of said frame means adapted for coupling to cooperative coupling means on an upper portion of said excavation tool;

connecting means slideably disposed along a longitudinal axis of a fixed length member on a lower portion of said frame means adapted for connecting to a lower portion of said excavation tool;

implement mounting means immovably secured to said lower portion of said frame means adapted for mounting working implements thereon; and parking means extending a distance from said lower portion of said frame means for orienting said coupling means at a sufficient height above a surface when said implement adapter is supported on said surface by said parking means and said lower portion of said frame means, wherein said sufficient height is adapted to enable engagement of said coupling means with said cooperative coupling means on said excavation tool with no manual assistance.

2. The implement adapter of claim 1, wherein said connecting means further comprises fastening means adapted to semi-fixedly fasten said connecting means to said excavation tool.

3. The implement adapter of claim 2, wherein said fastening means comprises a fastening assembly fastened through a hole in said connecting means adapted to fasten to a corresponding hole in said excavation tool.

4. The implement adapter of claim 2, wherein said fastening means comprises a remotely actuated mechanism adapted for fastening said connecting means to said excavation tool.

5. The implement adapter of claim 1, wherein said connecting means is angularly rotatable about said longitudinal axis of said fixed length member of said frame means, wherein said parking means is a distal end of said connecting means, and wherein said parking means is adapted to rotate into and out of latching engagement with a reciprocal latching element on said excavation tool when said fixed length member is rotated.

6. The implement adapter of claim 5, wherein said connecting means further comprises fastening means adapted to semi-fixedly fasten said connecting means to said excavation tool.

7. The implement adapter of claim 6, wherein said fastening means comprises a fastening assembly fastened through a hole in said connecting means adapted to fasten to a corresponding hole in said excavation tool.

8. The implement adapter of claim 6, wherein said fastening means comprises a remotely actuated mechanism adapted for fastening said connecting means to said excavation tool.

9. The implement adapter in accordance with claim 1, wherein said connecting means is semi-fixedly attached to said fixed length member.

10. The implement adapter in accordance with claim 1, wherein said frame means further comprises two parallel spaced arms with said coupling means having a semicircular bearing surface on upper distal ends of each of said parallel spaced arms adapted for pivotal coupling with a mating circular element of said cooperative coupling means.

11. The implement adapter in accordance with claim 1, wherein said coupling means further comprises a coupling rod fixably attached to an upper end portion of said frame means adapted for pivotal coupling with at least one semicircular bearing surfaces on said cooperative coupling means.

12. The implement adapter in accordance with claim 1, wherein said frame means is adjustable in length along a vertical axis.

13. The implement adapter in accordance with claim 1, wherein said implement mounting means further comprises:

pivot means adapted for enabling rotational movement of said mounted working implements about an axis orthogonal to the vertical axis of said frame means.

14. The implement adapter in accordance with claim 13, wherein said pivot means further comprises:

remotely actuated rotational means coupled to said implement mounting means and adapted to be coupled to a mounted working implement for actuated rotation of said mounted working implement.

15. The implement adapter in accordance with claim 1, wherein said implement mounting means further comprises:

pivot means adapted for enabling rotational movement of said mounted working implements about an axis parallel to the vertical axis of said frame means.

16. The implement adapter in accordance with claim 15, wherein said pivot means further comprises:

remotely actuated rotational means coupled to said implement mounting means and said frame means for hydraulically actuated rotation of said mounted working implement.

17. The implement adapter in accordance with claim 1, said implement mounting means further comprising:

a rearward facing planar surface on each distal end of said implement mounting means, said rearward facing planar surface adapted to engage a mating parallel surface of wear plate means mounted on said working implement.

18. The implement adapter in accordance with claim 1, wherein said parking means is a distal end of said connecting means.

19. The implement adapter in accordance with claim 1, wherein said parking means further comprises a parking foot projecting orthogonal to a longitudinal axis of said parking means.

20. The implement adapter in accordance with claim 1, further comprising load transfer means fixably mounted on a lower portion of said frame means adapted for engagement with a forward edge of said excavation tool.

21. An implement adapter for use in combination with an excavation tool, said implement adapter comprising:

frame means for holding working implements;

coupling means integral with an upper portion of said frame means adapted for coupling to cooperative coupling means on an upper portion of said excavation tool;

connecting means rotatably disposed about an axis of a rotational member connected to a lower portion of said frame means adapted for latching engagement with a lower portion of said excavation tool;

implement mounting means immovably secured to said lower portion of said frame means adapted for mounting working implements thereon; and parking means extending a distance from said lower portion of said frame means for orienting said coupling means at a sufficient height above a surface when said implement adapter is supported on said surface by said parking means and a lowermost portion of said frame means, wherein said sufficient height is adapted to enable engagement of said coupling means with said cooperative coupling means on said excavation tool with no manual assistance.

22. The implement adapter of claim 21, wherein said connecting means further comprises fastening means adapted to semi-fixedly fasten connecting means to said excavation tool.

23. The implement adapter of claim 22, wherein said fastening means comprises a fastening assembly fastened through a hole in said connecting means adapted to fasten to a corresponding hole in said excavation tool.

24. The implement adapter of claim 22, wherein said fastening means comprises a remotely actuated mechanism adapted for fastening said connecting means to said excavation tool.

25. The implement adapter in accordance with claim 21, wherein said frame means further comprises two parallel spaced arms with said coupling means having a semicircular bearing surface on upper distal ends of each of said parallel spaced arms adapted for pivotal coupling with a mating circular element on said cooperative coupling means.

26. The implement adapter in accordance with claim 21, wherein said coupling means further comprises a coupling rod fixably attached to an upper end portion of said frame means adapted for pivotal coupling with a semicircular bearing surface on said cooperative coupling means.

27. The implement adapter in accordance with claim 21, wherein said frame means is adjustable in length along a vertical axis.

28. The implement adapter in accordance with claim 21, wherein said implement mounting means further comprises:

pivot means adapted for enabling rotational movement of said mounted working implements about an axis orthogonal to the vertical axis of said frame means.

29. The implement adapter in accordance with claim 28, wherein said pivot means further comprises:

remotely actuated rotational means coupled to said implement mounting means and adapted to be coupled to a mounted working implement for actuated rotation of said mounted working implement.

30. The implement adapter in accordance with claim 21, wherein said implement mounting means further comprises:

pivot means adapted for enabling rotational movement of said mounted working implements about an axis parallel to the vertical axis of said frame means.

31. The implement adapter in accordance with claim 30, wherein said pivot means further comprises:

remotely actuated rotational means coupled to said implement mounting means and said frame means for actuated rotation of said mounted working implement.

32. The implement adapter in accordance with claim 21, said implement mounting means further comprising:

a rearward facing planar surface on each distal end of said implement mounting means, said rearward facing planar surface adapted to engage a mating parallel surface of wear plate means mounted on said working implement.

33. The implement adapter in accordance with claim 21, wherein said parking means is a distal end of said connecting means, and wherein said parking means is adapted to rotate into and out of a latching engagement with a reciprocal latching element of said excavation tool when said rotational member is rotated.

34. The implement adapter in accordance with claim 21, wherein said parking means further comprises a parking foot projecting orthogonal to a longitudinal axis of said parking means.

35. The implement adapter in accordance with claim 21, further comprising load transfer means fixably mounted on said lower portion of said frame means for engagement with a forward edge of said excavation tool.

36. A method of machine mounting an implement adapter upon an excavation tool assembly, said implement adapter characterized by frame means for holding working implements, coupling means integral with an upper portion of said frame means for coupling to cooperative coupling means on an upper portion of said excavation tool assembly, connecting means slideably disposed along a longitudinal axis of a fixed length member on a lower portion of said frame means for connecting to a lower portion of said excavation tool assembly load transfer means fixably mounted on said lower portion of said frame means for engagement with a forward edge of said excavation tool assembly implement mounting means immovably secured to said lower portion of said frame means for mounting working implements thereon, and parking means extending a distance from said lower portion of said frame means, the steps including:

moving said connecting means along said fixed length member;

fixably securing said connecting means to said fixed length member;

resting said implement adapter upon a surface so that said parking means and a lower portion of said implement adapter contact said surface;

subjecting said coupling means to an upward moving cooperative coupling means of said excavation tool assembly;

subjecting said implement adapter to pivotal upward displacement about an axis collinear with said lower portion of said implement adapter simultaneous with and dependent upon the continuing engagement of said coupling means with said cooperative coupling means of said excavation tool assembly; and connecting said implement adapter to said excavation tool assembly with said connecting means;

wherein said implement adapter is securely mounted upon said excavation tool assembly.

37. A method of machine mounting an implement adapter upon an excavation tool assembly, said implement adapter characterized by frame means for holding working implements, coupling means integral with an upper portion of said frame means for coupling to cooperative coupling means on an upper portion of said excavation tool assembly, connecting means rotatably disposed about an axis of rotational member on a lower portion of said frame means for latching engagement with said excavation tool assembly, implement mounting means immovably secured to said lower portion of said frame means for mounting working implements thereon, and parking means extending a distance from said lower portion of said frame means, the steps including:

resting said implement adapter upon a surface so that said parking means and a lower portion of said implement adapter contact said surface;

subjecting said coupling means to an upward moving cooperative coupling means of said excavation tool assembly;

subjecting said implement adapter to pivotal upward displacement about an axis collinear with said lower portion of said implement adapter simultaneous with and dependent upon the continuing engagement of said coupling means with said cooperative coupling means of said excavation tool assembly; and rotating said connecting means about said axis of said rotational member thereby latching said parking means with a reciprocal latching element on said excavation tool assembly wherein said implement adapter is securely mounted upon said excavation tool assembly.

* * * * *